US007506407B2

(12) United States Patent
Ishiwata

(10) Patent No.: US 7,506,407 B2
(45) Date of Patent: Mar. 24, 2009

(54) TORQUE ADJUSTING TYPE HINGE

(75) Inventor: Mitsuhiro Ishiwata, Tokyo (JP)

(73) Assignee: Takigen Manufacturing Co. Ltd., Tokyo (JP)

( * ) Notice: Subject to any disclaimer, the term of this patent is extended or adjusted under 35 U.S.C. 154(b) by 436 days.

(21) Appl. No.: 11/377,112

(22) Filed: Mar. 16, 2006

(65) Prior Publication Data

US 2006/0225248 A1 Oct. 12, 2006

(30) Foreign Application Priority Data

Nov. 4, 2005 (JP) ..... 2005-320594

(51) Int. Cl.
*E05D 11/08* (2006.01)

(52) U.S. Cl. ..... 16/340; 16/342

(58) Field of Classification Search ..... 16/340, 16/337, 338, 341, 342, 273; 403/150, 128, 403/120, 135, 133, 132, 119, 226
See application file for complete search history.

(56) References Cited

U.S. PATENT DOCUMENTS

| | | | | | |
|---|---|---|---|---|---|
| 454,243 | A * | 6/1891 | Witham | 278/61 |
| 540,764 | A * | 6/1895 | Spring | 403/150 |
| 1,637,642 | A * | 8/1927 | Hilton | 16/340 |
| 1,847,937 | A * | 3/1932 | Fetters | 16/339 |
| 1,956,040 | A * | 4/1934 | Meyer | 16/340 |
| 2,366,860 | A * | 1/1945 | Kraft | 403/224 |
| 3,837,042 | A * | 9/1974 | White | 16/339 |
| 4,186,905 | A * | 2/1980 | Brudy | 248/478 |
| 4,489,974 | A * | 12/1984 | Warhol | 296/97.5 |
| 4,639,147 | A * | 1/1987 | Schwarz | 384/125 |
| 5,333,356 | A * | 8/1994 | Katagiri | 16/340 |
| 5,388,308 | A * | 2/1995 | Meeuwissen | 16/340 |
| 5,572,768 | A * | 11/1996 | Daul | 16/49 |
| 5,715,576 | A * | 2/1998 | Liu | 16/342 |

* cited by examiner

*Primary Examiner*—Chuck Y. Mah
(74) *Attorney, Agent, or Firm*—Martin Smolowitz

(57) ABSTRACT

A torque adjusting hinge capable of easily and precisely controlling its frictional torque, being totally downsized and free from wear in its pivot pin. The hinge employs a cylindrical drive element is between the pivot pin and a sleeve-like bearing of a stationary wing and a sleeve-like bearing of a movable wing; a frictional element is disposed between a sleeve-like bearing of the stationary wing and a sleeve-like bearing of the movable wing; a swash plate-like surface formed in the cylindrical drive element is provided and abuts against a swash plate-like surface formed in the cylindrical friction element; and a nut threadably engaged with a threaded pin portion of the pivot pin when tightened, causes axial movement of the cylindrical drive element in a longitudinal direction of the pivot pin, whereby a controlled friction torque is produced between an outer peripheral surface of the cylindrical friction element and an inner peripheral surface of the sleeve-like bearing.

2 Claims, 3 Drawing Sheets

TORQUE ADJUSTING TYPE HINGE

BACKGROUND OF THE INVENTION

1. Field of the Invention

The present invention relates to a torque adjusting type hinge adapted to control the angles at which a display unit or swinging cover a notebook-type personal computer or of a word processor is tilted when in use.

2. Description of the Related Art

When using an electronic instrument such as a notebook type personal computer or the like, it is necessary to hold the display unit of the electronic instrument at an appropriate tilting angle which the user may require. Heretofore, it has been known to employ a hinge using its frictional resistance for preventing the display unit from freely rotating.

In one example of such conventional hinge using the frictional resistance, a resilient member assuming having a pipe-like shape is inserted into a cylindrical base member with one of its opposite ends open and the other closed to form its bottom; a small-diameter portion of a stepped-diameter pin element is inserted into the resilient member and is press-fitted therewith so as to enlarge in the diameter of the resilient member, causing the resilient member to have its outer peripheral surface press-fitted to an inner peripheral surface of the base member. In other words, the resilient member is inserted into the base member in a manner such that the resilient member is prevented from freely rotating relative to the base member because of the presence of a frictional resistance between the resilient member and the base member. The stepped-diameter pin element has an end of its large-diameter portion connected with a display unit having a base member fixedly mounted on a main body of the electronic instrument. Due to such arrangement, the frictional resistance produced between the base member and the resilient member permits the user to hold the display unit in a stationary tilted position.

The conventional hinge mentioned above is, disadvantageous in that the press-fitting degree of the pin element to the resilient member is too apt to vary. This leads to variations in frictional resistance and makes it difficult to keep the holding power of the pin element constant. As a result, it is difficult to mass-produce a product with constant characteristics. Furthermore, the conventional hinge has the disadvantage of not being durable, because of the lack of means for compensating for wear occurring in the resilient member from use, causing a decrease in the frictional resistance between the resilient member and the pin element.

Attempts have been made to solve the problem of variations in frictional resistance as well as deterioration or decrease in frictional resistance over time. Further consideration is also proposed in another conventional torque adjusting type hinge as in Japanese Utility Model registration No. 253005. According to this arrangement, a pin element is provided to co-operate with a holder member, which assumes a sleeve-like shape for rotatably holding the pin element rotatably therein relative to the holder member. The holder member has one of its opposite ends open and the other is closed to form its bottom. A resilient member, is interposed between the pin element and the holder member to produce a frictional resistance when the pin element is rotated relative to the holder member. A compression spring is provided for axially urging the resilient member in a longitudinal direction of the pin element.

However, this conventional torque adjusting type hinge compression spring is also disadvantageous. This construction is large in size, and therefore requires a large storage and installation space in the electronic instrument. This limits the field of application for the conventional hinge and represents another problem inherent in the conventional hinge.

In Japanese Patent application Laid-Open No. 2004-169360, there is proposed another torque adjusting type hinge. This conventional hinge employs a compact mechanism for adjusting a frictional torque therein. More specifically, this type of conventional hinge construction has a support member mounted on a main body of the instrument; and a rotary pin, is rotatably mounted on a support member having a plurality of inclined friction plates, which are tiltably mounted thereon. A forcing screw is employed for urging the inclined friction plates to tilt.

However, this type of the conventional hinge is also disadvantageous, in that the rotary pin exhibits considerable wear while in use. This is due to the presence of a bite-type interference occurring between the rotary pin and its counterpart,—namely, wall surface of an annular frictional portion of each of the inclined friction plates. The annular frictional portion is integrally formed with a pressure receiving portion of each of the inclined friction plates, whereby the pressure receipt receiving portion is urged by the forcing screw in the hinge as it is advanced.

SUMMARY OF INVENTION

Under such circumstances, the present invention was made to solve the problems inherent in the prior art.

Consequently, it is an objection of the present invention to provide a torque adjusting type hinge, which is capable of controlling its friction torque in an easy manner without failure. Another object is to downsize the hinge as a whole and to be free from any wear in its pivot pin even with elapsed time.

The object of the present invention is accomplished by providing an improved torque adjusting type hinge comprising: a stationary wing plate (1) fixedly mounted on a stationary frame element (3); a movable wing plate (5) fixedly mounted on a wing element (7); and, a pivot pin (9), which is inserted into both a sleeve-like bearing portion (4) of the stationary wing plate (1) and a sleeve-like bearing portion (8) of the movable wing plate (5) so as to rotatably connect the movable wing plate (5) with the stationary wing plate (1).

The improvement resides in providing structure employing a cylindrical drive element (14) that is radially interposed between: the pivot pin (9) and, one of the sleeve-like bearing portion (4) of the stationary wing plate (1) and the sleeve-line bearing portion (8) of the movable wing plate (5) in a radius direction of the pivot pin (9).

A further aspect employs a cylindrical friction element (15) is radially interposed between the pivot pin (9) and, the remaining one of the sleeve-like bearing portion (4) of the stationary wing plate and the sleeve-like bearing portion (8) of the movable wing plate (5) in a radius direction of the pivot pin (9) a swash plate-like surface (17) is provided which is formed in an axial end portion of the cylindrical drive element (14), and abuts against a swash plate-like surface (18) formed in an axial end portion of the cylindrical friction element (15) and a nut (19), which is threadably engaged with a threaded pin portion (12) formed in an end portion of the pivot pin (9), when tightened, axially moves the cylindrical drive element (15) in a longitudinal direction of the pivot pin (9), so that the swash plate-like surfaces (17, 18) moves the cylindrical friction element (15) radially outwardly in a radius direction of the pivot pin (9), whereby the cylindrical friction element (15) has its outer peripheral surface brought into press-contact with its counterpart, that is, an inner peripheral surface of the sleeve-like bearing portion (4, 8). As a result, a friction torque is developed between the outer peripheral surface of the cylindrical friction element (15) and the inner peripheral surface of the sleeve-like bearing portion (4, 8). In this manner, the frictional torque is controlled with reference to both the weight of the wing element (7) as well as its angular position, resulting in a desired condition.

It is also possible to accomplish a further object of the present invention by providing] an improved torque adjusting type hinge comprising: a stationary wing plate (1) fixedly mounted on a stationary frame element (3); a movable wing plate (5) fixedly mounted on a wing element (7); and, a pivot pin (9), which is inserted into both a pair of sleeve-like bearing portions (4) of the stationary wing plate (1) and a sleeve-like bearing portion (8) of the movable wing plate (5) so as to rotatably connect the movable wing plate (5) with the stationary wing plate (1). The improvement, additionally resides in having a pair of cylindrical drive elements (14) are provided whereby each of the cylindrical drive elements (14) is axially interposed between the pivot pin (9) and both the sleeve-like bearing portions (4) of the stationary wing plate (1) and the sleeve-like bearing portion (8) of the movable wing plate (5) in a radius direction of the pivot pin (9);

a cylindrical friction element (15) is radially interposed between the pivot pin (9) and the sleeve-like bearing portion (8) of the movable wing plate (5) in a radius direction of the pivot pin (9), the cylindrical friction element (15) additionally being axially interposed between the pair of cylindrical drive elements (14); a swash plate-like surface (17) is provided which is formed in one of opposite end portions of the cylindrical drive element (14) and abuts against a swash plate-like surface (18) formed in each of opposite end portions of the cylindrical friction element (15); and a nut (19) which is threadably engaged with a threaded pin portion (12) formed in an end portion of the pivot pin (9), when tightened axially moves the cylindrical drive element (15) in a longitudinal direction of the pivot pin (9), so that the swash plate-like surfaces (17, 18) perform their guiding operation to move the cylindrical friction element (15) radially outwardly in a radius direction of the pivot pin (9), whereby the cylindrical friction element (15) has its outer peripheral surface brought into press-contact with its counterpart, that is, an inner peripheral surface of the sleeve-like bearing portion (8) of the movable wing plate (5). As a result, a friction torque is developed between the outer peripheral surface of the cylindrical friction element (15) and the inner peripheral surface of the sleeve-like bearing portion (8) of the movable wing plate (5). The resulting friction torque is controlled with reference to both the desired weight and angular position of the wing element (7).

According to the present invention, several advantages are as follows:

The torque adjusting type hinge of the present invention is capable of adjusting its frictional torque in an easy manner without failure for certain applications. This is determined by a stroke of the nut in its axially back-and-forth movement in a direction of the pivot pin, because it is possible to control the frictional resistance produced between the outer peripheral surface of the cylindrical friction element and the corresponding inner peripheral surface of the sleeve-like bearing portion of the movable wing plate, through variation movement of both the cylindrical drive element and the cylindrical friction element by controlling the tightness of the nut. In other words, when the nut, which is threadably engaged with the threaded pin portion formed at the end portion of the pivot pin, is tightened, the cylindrical drive element is axially moved in a longitudinal direction of the pivot pin. As a result, both the swash plate-like surfaces of these drive and friction elements perform their guiding operation to radially move the cylindrical friction element in a radius direction of the pivot pin. This action causes the outer peripheral surface of the cylindrical friction element to be brought into press-contact with its counterpart, that is, the inner peripheral surface of the sleeve-like bearing portion of the wing plate. A friction torque is produced between the outer peripheral surface of the cylindrical friction element and the inner peripheral surface of the sleeve-like bearing portion of the wing plate.

Furthermore, in the torque adjusting type hinge of the present invention, the cylindrical drive element is radially interposed between the pivot pin and the sleeve-like bearing portion of the wing plate in an insertion manner. The cylindrical friction element is radially interposed between the pivot pin and the sleeve-like bearing portion of the other wing plate in an insertion manner; and, it suffices for the sleeve-like bearing portion of each of the wing plates to have its axial length and its radius enlarged. This permits the cylindrical drive element to move in a longitudinal direction of the pivot pin and also permits the cylindrical friction element to move in a radius direction of the pivot pin. Such construction allows for downsize of the hinge of the present invention as a whole in comparison with the conventional torque adjusting type hinge. As a result, the hinge of the present invention is capable of effectively saving storage and installation space in the instrument, resulting in a greater range of applications.

Also, according to the torque adjusting type hinge of the present invention, the swash plate-like surface of the cylindrical drive element is engaged with the pivot pin in an insertable manner; and is abutted on its counterpart, that is, the corresponding swash plate-like surface of the cylindrical friction element engaged with the pivot pin in an insertable manner; while the cylindrical friction element is engaged with the sleeve-like bearing portion of the remaining one of the wing plates in an insertable manner. As the nut is tightened, the outer peripheral surface of the cylindrical friction element is brought into press-contact with the corresponding inner peripheral surface of the sleeve-like bearing portion of the remaining one of the wing plates, all of which results in having the hinge of the present invention is free from any wear of the pivot pin even with the elapse of time.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Figure 1:
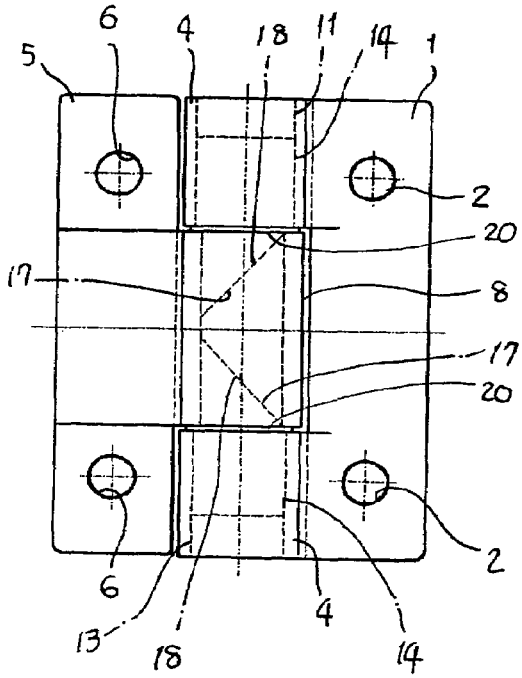
FIG. 1 is a front view of an embodiment of a torque adjusting type hinge according to the present invention.
Figure 2:
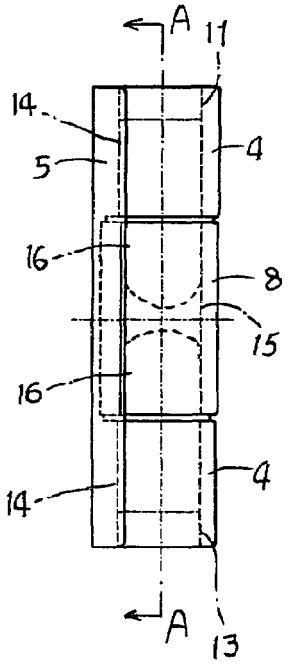
FIG. 2 is a left side view of the hinge shown in FIG. 1.
Figure 3:
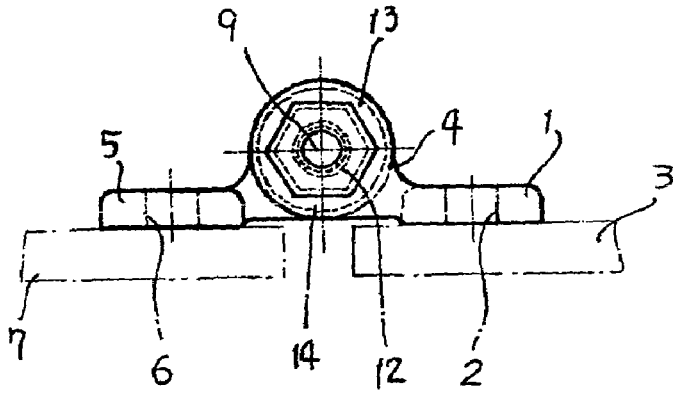
FIG. 3 is a bottom view of the hinge shown in FIG. 1.
Figure 4:
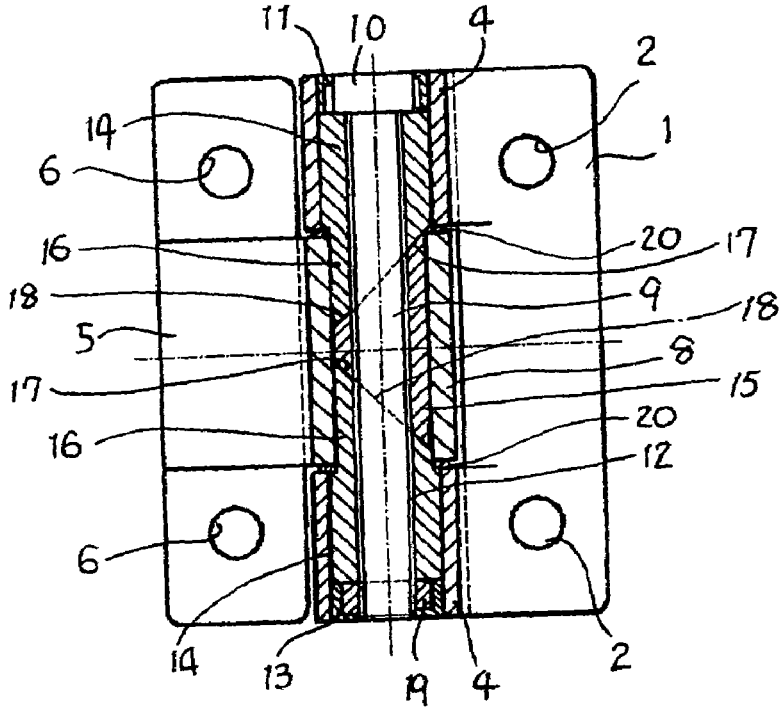
FIG. 4 is a longitudinal sectional view of the hinge of the present invention, taken along the line A-A of FIG. 2.
Figure 5:
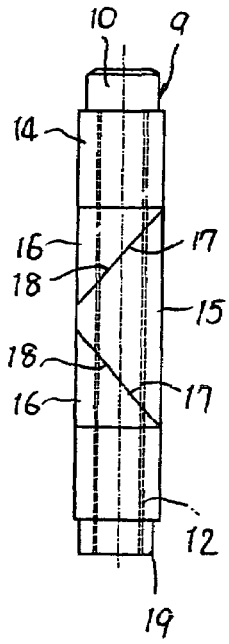
FIG. 5 is a front view of an assembly of three parts, that is, the pivot pin, the cylindrical drive element and the cylindrical friction element all used in the hinge shown in FIG. 1.
Figure 6:
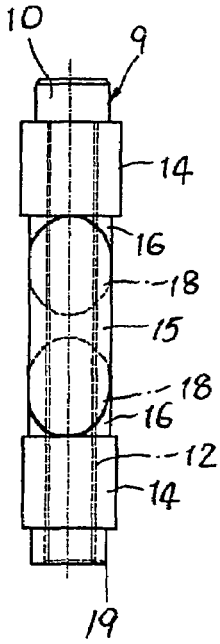
FIG. 6 is a left side view of the assembly shown in FIG. 5.

The best modes for carrying out the present invention will be described in detail using embodiments of the present invention with reference to the accompanying drawings, in which:

The reference numerals identify the respective structural elements of the invention—1 denotes a stationary wing plate;

2 a through-hole of the stationary wing late 1; 3 a stationary frame element; 4 a sleeve-like bearing portion of the stationary wing plate; 5 a movable wing plate; 6 a through-hole of the movable wing plate 5; 7 a wing element; 8 a sleeve-like bearing portion of the movable wing plate; 9 a pivot pin; 10 a head portion of the pivot pin; 11 a cap for covering the head portion; 12 a threaded pin portion of the pivot pin; 13 a cap for covering a nut; 14 a cylindrical drive element; 15 a cylindrical friction element; 16 a small-diameter portion of the cylindrical drive element 14; 17 a swash plate-like surface of the cylindrical drive element 14; 18 a swash plate-like surface of the cylindrical friction element 15; 19 the nut; and 20 a washer.

In an embodiment of the present invention shown in the drawings, the stationary wing plate 1 is made of a plastic material excellent in mechanical strength, and fixedly mounted on the stationary frame element 3 such as a casing of an electric instrument or the like, through a fastener such as a bolt or the like, and passing through the through-hole 2 of a main body portion of the stationary wing plate 1. In this embodiment, two pieces of the sleeve-like bearing portions 4 of the stationary wing plate 1 are axially spaced apart from each other in longitudinal direction of the pivot pin 9 in one of opposite sides of the stationary wing plate 1. On the other hand, the movable wing plate 5 is also made of a plastic material, excellent in mechanical strength, and fixedly mounted on the wing element 7 such as a swinging cover of an electric instrument or the liken through a fastener such as a bolt or the like, passing through the through-hole 6 of a main body portion of the movable wing plate 5. A single piece of the sleeve-like bearing portion 8 of the movable wing plate 5 is provided in a central area of one of opposite sides of the movable wing plate 5.

The pivot pin 9, which is made of metal, is formed into a bolt-like shape, is received in one of the sleeve-like bearing portions 4 of the stationary wing plate 1 at its head portion 10. The cap 11 is made of a plastic material and radially interposed between such one of the sleeve-like bearing portions 4 of the stationary wing plate 1 and the heed portion 10 of the pivot pin 9 in a radius direction of the pivot pin 9 in an insertion manner. The pivot pin 9 has its threaded pin portion 12 received in the remaining one of the sleeve-like bearing portions 4 of the stationary wing plate 1. The cap 13, made of a plastic material, is radially interposed between the remaining one of the sleeve-like bearing portions 4 of the stationary wing plate 1 and a front end of the threaded pin portion 12 of the pivot pin 9 in a radius direction of the pivot pin 9 in an insertion manner.

Two pieces of the cylindrical drive elements 14 and a single piece of the cylindrical friction element 15, are provided and each is made of plastic materials having excellent mechanical strength. The small-diameter portion 16 of each of the cylindrical drive elements 14 is inserted into the sleeve-like bearing portion 8 of the movable wing plate 5. Formed in one of the opposite end portions of this small-diameter portion 16 is the swash plate-like surface 17, which surface 17 is inclined at an angle of 45 degrees relative to a center axis of the pivot pin 9. Further formed in opposite end portions of the cylindrical friction element 15 are a pair of the swash plate-like surfaces 18 each of which is inclined at an angle of 45 degrees relative to the center axis of the pivot pin 9 so that each of the swash plate-like surfaces 18 is abutted on each of the corresponding swash plate-like surfaces 17 of the cylindrical drive elements 14.

A metal nut 19, is provided and threadably engages the threaded pin portion of the pivot pin 9. Cap 13 is radially interposed between the nut 19 and the sleeve-like bearing portion 4 of the stationary wing plate 1 in a radius direction of the pivot pin 9 in an insertion manner. A washer 20 is axially interposed between an end surface of each of the sleeve-like bearing portions 4 of the stationary wing plate 1 and the corresponding end surface of the sleeve-like bearing portion 8 of the movable wing plate 5 in a longitudinal direction of the pivot pin 9 in an insertion manner.

When the nut 19 is tightened so as to move toward the head portion 10 of the pivot pin 9, each of the cylindrical drive elements 14 is axially moved in a longitudinal direction of the pivot pin 9 by the same distance as that of the nut 19 thus tightened and moves axially. As a result, each of the swash plate-like surfaces 17, 18 performs its guiding operation so that the cylindrical friction plate 15 is moved radially outwardly in a radius direction of the pivot pin 9, whereby the outer peripheral surface of the cylindrical friction element 15 is brought into press-contact with the corresponding inner peripheral surface of the sleeve-like bearing portion 8 of the movable wing plate 5. The resultant press-contact thus accomplished, produces a friction torque in the hinge.

On the other hand, when the nut 19 is loosened so as to be axially moved further apart from the head portion 10 of the pivot pin 9 by a predetermined axial distance, each of the cylindrical drive elements 14 is also axially moved apart from each in a longitudinal direction of the pivot pin 9 by the same axial distance as that of the nut 19 thus. The swash plate-like surfaces 17, 18 are allowed to perform their guiding operation, and the cylindrical friction element 15 is moved radially inwardly in a radius direction of the pivot pin 9. This decreases the degree of press-contact of the outer peripheral surface of the cylindrical friction element 15 with the corresponding inner peripheral surface of the sleeve-like bearing portion 8 of the movable wing plate 5, so that the friction torque of the hinge is decreased.

In use, the friction torque of the hinge is appropriately controlled, that is, increased and decreased with reference to both the weight and angular position of the wing element 7 consistent with which the user wants.

Finally, the present application claims the Convention Priority based on Japanese Patent Application No. 2005 320594 filed on Nov. 4, 2005, which is herein incorporated by reference.

What is claimed is:

1. In a torque adjusting type hinge comprising: a stationary wing plate (1) fixedly mounted on a stationary frame element (3); a movable wing plate (5)fixedly mounted on a wing element (7); and, a pivot pin (9), which is inserted into both sleeve-like bearing portion (4) of said stationary wing plate (1) and a sleeve-like bearing portion (8) of said movable wing plate (5) so as to rotatably connect said movable wing plate (5) with said stationary wing plate (1); the improvement wherein, a pair of cylindrical drive element (14), each of said cylindrical drive elements (14) is radially interposed between said pivot pin (9) and at least a portion of one of said sleeve-like bearing portion (4), of said stationary wing plate (1), and a small diameter portion of each of said cylindrical drive elements (14) is radically interposed between said pivot pin (9) and at least a portion of said sleeve-like bearing portion (8) of said movable wing plate (5) in a radius direction of said pivot pin (9);

a cylindrical friction element (15), is radially interposed between said pivot pin (9) and the remaining portions of said sleeve-like bearing portion (4, 8) of said stationary wing plate and said sleeve-like bearing portion (8) of said movable wing plate (5) in a radius direction of said pivot pin (9);

a swash plate-like surface (17) formed in a respective axial end portion of each of said cylindrical drive elements (14) is abutted against a swash plate-like surface (18) formed in a respective axial end portion of said cylindrical friction element (15);

a nut (19), is threadably engaged with a threaded pin portion (12) formed in an end portion of said pivot pin (9), and said nut (19) is tightened to axially move each of said cylindrical drive elements (14) towards each other in a longitudinal direction of said pivot pin (9), so that said swash plate-like surfaces (17, 18) perform a guiding operation to move said cylindrical friction element (15) radially outwardly in a radius direction of said pivot pin (9), whereby said cylindrical friction element (15) has its outer peripheral surface brought into press-contact with an inner peripheal surface of at least one of the sleeve-like bearing portions (4, 8) causing said inner peripheral surface of said sleeve-like bearing portions (4, 8) to produce a friction torque between said outer peripheral surface of said cylindrical friction element (15) and said inner peripheal surface, whereby said friction torque is controlled with reference to both a desired weight of and an angular position of said wing element (7).

2. In a torque adjusting type hinge comprising: a stationary wing plate (1) fixedly mounted on a stationary frame element (3); a movable wing plate (5) fixedly mounted on a wing element (7); and, a pivot pin (9), which is inserted into both a pair of sleeve-like bearing portions (4) of said stationary wing plate (1) and a sleeve-like portion (8) of said movable wing plate (5) so as to rotatably connect said movable wing plate (5) with said stationary wing plate (1); the improvement wherein, a pair of cylindrical drive elements (14); said cylindrical drive elements (14) being radically interposed between said pivot pin (9) and each of said sleeve-like bearing portion (8) of said movable wing plate (5) in a radius direction of said pivot pin (9);

a cylindrical friction element (15); said cylindrical friction element (15) is radially interposed between said pivot pin (9) and said sleeve-like bearing portion (8) of said movable wing plate (5) in a radius direction of said pivot pin (9), said cylindrical friction element (15) being axially interposed between said pair of cylindrical drive elements (14) in a longitudinal direction of said pivot pin (9);

a swash plate-like surface (17) formed in one of opposite end portions of each of said cylindrical drive elements (14) is abutted against a swash plate-like surface (18) formed in each of opposite end portions of said cylindrical friction element (15);

a nut (19), said nut 19, is threadably engaged with a threaded pin portion (12) formed in an end portion of said pivot pin (9), and is tightened to axially move each of said cylindical drive elements (14) towards each other in a longitudinal direction of said pivot pin (9), so that said swash plate-like surfaces (17, 18) perform a guiding operation to move said cylindrical friciton element (15) radically outwardly in a radius direction of said pivot pin (9), whereby said cylindrical friction element (15) has its outer peripheral surface brought into press-contact with an inner peripheal surface at least one of the sleeve-like bearing portion (4, 8), causing said inner peripheral surface of said sleeve-like bearing portion (8) of said movable wing plate (5) to produce a friction torque between said outer peripheral surface of said cylindrical friction element (15) and said inner peripheral surface of said sleeve-like bearing portion (8) of said movable wing plate (5), wherein said friction torque of the hinge is controlled with reference to both a weight and angular position of said wing element (7).

* * * * *